United States Patent [19]

Hiraga

[11] 4,039,270

[45] Aug. 2, 1977

[54] FLUID SUCTION AND DISCHARGE APPARATUS

[75] Inventor: Masaharu Hiraga, Isesaki, Japan

[73] Assignee: Sankyo Electric Industries, Ltd., Japan

[21] Appl. No.: 549,795

[22] Filed: Feb. 13, 1975

[30] Foreign Application Priority Data

Feb. 14, 1974 Japan ..... 49-17172[U]
Feb. 14, 1974 Japan ..... 49-17173[U]

[51] Int. Cl.[2] ..... F04B 39/10; F04B 21/02
[52] U.S. Cl. ..... 417/569; 137/514
[58] Field of Search ..... 417/506, 559, 562, 563, 417/565, 569, 564; 137/525.3, 525.5, 514, 512.4, 512.5, 856

[56] References Cited

U.S. PATENT DOCUMENTS

| | | | |
|---|---|---|---|
| 1,748,531 | 2/1930 | Troup | 137/512.4 |
| 1,892,711 | 1/1933 | Summers | 137/512.4 |
| 1,915,694 | 6/1933 | Reindel | 137/514 X |
| 2,019,747 | 11/1935 | Taylor | 137/525.5 |
| 2,154,880 | 4/1939 | Twigg | 137/525.5 |
| 2,434,734 | 1/1948 | Buschmann | 417/565 |

FOREIGN PATENT DOCUMENTS

| | | | |
|---|---|---|---|
| 413,855 | 3/1910 | France | 417/565 |
| 556,690 | 9/1922 | France | 417/565 |
| 32,403 | 5/1911 | Sweden | 137/514 |

*Primary Examiner*—William L. Freeh
*Assistant Examiner*—Edward Look
*Attorney, Agent, or Firm*—Carothers and Carothers

[57] ABSTRACT

A fluid suction and discharge apparatus suitable for a compressor for an air-conditioning system for automobiles, having means for extending the life time of the suction reed valve and for suppressing noise due to the vibration of the suction reed valve. A pin having a head of an increased radius is secured to the inner surface of the valve plate with the pin extending through a slit provided in the suction reed valve at a portion between the secured end thereof and the region thereof facing the inlet port in the valve plate, whereby the suction reed valve may be suppressed from overbending. Another means for restricting the bending of the suction reed valve within a predetermined extent may be provided which comprises an axial recess formed in the inner surface of the cylinder from an end thereof facing the valve plate by a predetermined distance, with an extended free end of the suction reed valve being received in the recess.

6 Claims, 6 Drawing Figures

FLUID SUCTION AND DISCHARGE APPARATUS

BACKGROUND OF THE INVENTION

This invention relates to fluid suction and discharge apparatus, for example fluid compressors, and, in particular, to improvements of a valve mechanism of such apparatus.

A known fluid suction and discharge apparatus includes a cylinder block formed with a cylinder having a closed end and a piston slidably close-fitted in the cylinder. An end plate of the closed end of the cylinder has an inlet port and an outlet port which are connected with an inlet manifold and an outlet manifold, respectively. These two ports are closed by suction and discharge reed valves respectively which regulate communication between the cylinder and the inlet manifold or the outlet manifold.

A fluid is drawn into the cylinder from the inlet manifold through the inlet port and the suction reed valve as the piston completes its intake stroke, and, then, is expelled into the outlet manifold through the outlet port and the discharge reed valve as the piston complete its compression stroke.

The suction reed valve is disposed on the inner surface of the end plate to close the inlet port, with one end being a free end. Therefore, in the intake stroke of the piston the suction reed valve is bent inwardly due to the pressure difference between the inlet manifold and the cylinder so that the cylinder may communicate with the inlet manifold through the inlet port to permit the fluid to be drawn into the cylinder.

If the moving speed of the piston is more rapid in the intake stroke thereof, the suction reed valve is bent more which results in the fatigue or the breakage thereof.

Furthermore, when the suction reed valve is bent, the reed valve oscillates which develops a noise.

SUMMARY OF THE INVENTION

An object of this invention is to provide a fluid suction and discharge device wherein the life time of the suction reed valve is extended.

Another object of this invention is to provide a fluid suction and discharge device wherein the development of a noise due to the oscillation of the suction reed valve is suppressed.

This invention provides a fluid suction and discharge device wherein a stopper is provided to suppress the suction reed valve from bending over a predetermined bending degree, so as to realize the above object.

The stopper is disposed against a portion of the suction reed valve between the secured end and the portion thereof facing the inlet port.

Another stopper may be provided for the free end of the suction reed valve.

Further objects and features will be understood from the following descriptions of the embodiments of this invention referring to the annexed drawings.

DETAILED DESCRIPTION OF PREFERRED EMBODIMENTS

Figure 1A:
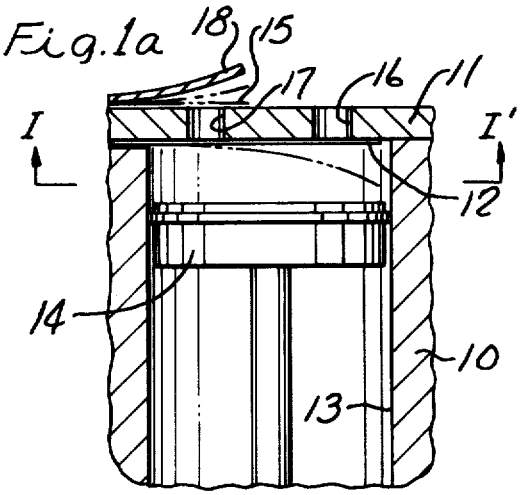
FIG. 1*a* is a sectional view of a known device.
Figure 1B:
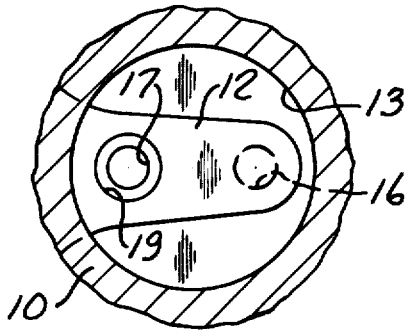
PRIOR ART Fig.1b PRIOR ART
FIG. 1*b* is a sectional view taken along line I–I' in FIG. 1*a*.

Referring to FIGS. 1*a* and 1*b*, which show a section of a known device comprising a cylinder block 10 formed with a cylinder 13, a valve plate 11 secured to the cylinder block 10 by means of, for example, bolt means (not shown) to close one end of the cylinder 13, and a piston 14 slidably close fitted into the cylinder 13.

The valve plate 11 has an inlet port 16 and an outlet port 17 which are connected with an inlet manifold and an outlet manifold (not shown), respectively.

Between the cylinder block 10 and the valve plate 11, an end of a suction reed valve 12 is secured, which valve 12 extends along the inner surface of the valve plate 11 over the inlet port 16 to terminate at a free end thereof.

To prevent the outlet port 17 from being closed by the suction reed valve 12, the suction reed valve 12 is provided with a hole 19 facing the outlet port 17.

On the outer surface of the valve plate 11, a discharge reed valve 15 is disposed, which is secured at one end and extends along the outer surface over the outlet port 17 of the valve plate to terminate at a free end. In case the discharge reed valve 15 extends over the inlet port 16, the valve is formed with a hole facing the inlet port so as to not close the inlet port.

When the piston 14 is drawn by means of a driving mechanism (not shown) to complete the intake stroke, the suction reed valve 12 is bent inwardly due to the pressure difference between the cylinder 13 and the inlet manifold (not shown) so that the fluid is sucked into the cylinder 13.

On the other hand, as the piston is moved to the compression stroke, the discharge reed valve 15 is bent outwardly to permit the fluid discharging from the cylinder 13 into the outlet manifold (not shown). In this period, the suction reed valve closes the inlet port 16.

When the movement of the piston is more rapid in each stroke thereof, each reed valve is bent more which results in the fatigue thereof or the breakage thereof.

To extend the life time of each reed valve and prevent each valve from the breakage, any means is required to be provided.

To this end, a stopper plate 18 is disposed, in the prior art, over the discharge reed valve 15 to limit the discharge reed valve 15 from bending over a predetermined bending degree. But, for the suction reed valve 12 no means has been provided to prevent the fatigue or the breakage thereof.

Therefore a principal object of this invention is to provide a means to prevent the suction reed valve from bending to such a degree that the suction reed valve may be subjected to fatigue or the breakage thereof.

Furthermore, the more the suction reed valve 12 is bent, the greater is the restoring force of the bent valve, so that the valve 12 may be vibrated when in the bending status thereof. Moreover, the valve 12 may also be vibrated upon striking with the valve plate 11 upon being closed. Accordingly a noise generates from the vibration of the suction reed valve.

Therefore, another object of this invention is to suppress the generation of noise due to the vibration of the suction reed valve.

Broadly stated, this invention intends to provide a means for limiting the bending extent of the suction reed valve to a predetermined extent so as to realize the above objects of this invention.

Figure 2A:
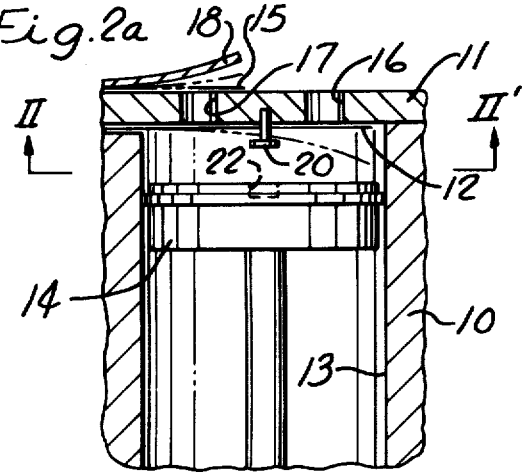
FIG. 2*a* is a sectional view of an embodiment of this invention.
Figure 2B:
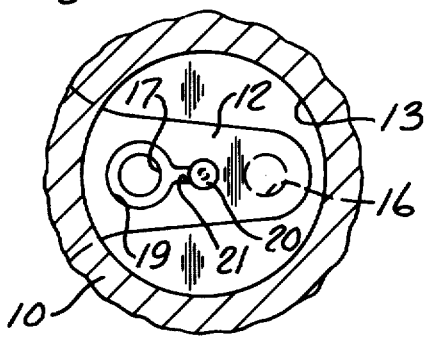
FIG. 2*b* is a sectional view taken along line II–II' in FIG. 2*a*.

Referring to FIGS. 2*a* and 2*b*, which show an embodiment of this invention, the device is similar to the known device in FIGS. 1*a* and 1*b*, except that a stopper means 20–21 is provided to prevent the suction reed valve 12 from bending over a predetermined extent.

Similar parts are indicated by same reference numerals as FIGS. 1*a* and 1*b*.

The stopper means is a pin 20 having a head of an increased radius, which extends through a slit 21 provided in the suction reed valve 12 and is secured to the inner surface of the valve plate 11, as shown in FIGS. 2*a* and 2*b*.

The pin 20 is located at a position between the inlet port 16 and the supporting point of the suction reed valve 12. Accordingly, the slit 21 is formed at a middle point of the suction reed valve 12. In the embodiment the slit 21 is continued with the hole 19 formed on the valve.

In this embodiment, even if a great force is applied to the suction reed valve 12 to bend the valve, the head of the pin 20 restrains the valve from further bending at the securing end. Therefore fatigue or the breakage of the valve 12 does not result, so that the life time of the suction reed valve may be extended.

Under the great force applied to the valve to bend it, the portion of the valve between the slit position and the free end is still further bent, but the fulcrum is not at the securing end of the reed valve but is shifted toward the slit position, so that the bending stress is not concentrated to a particular point on the reed valve such that the reed valve is not broken out.

It will be noted that the noise is suppressed by the embodiment because the available length of the reed valve becomes effectively shorter upon the increase of force applied to the valve to bend the valve.

The piston 14 is formed with a recess 22 for receiving the pin 20 so that the piston 14 may be moved to the final position in the compression stroke.

Figure 3A:
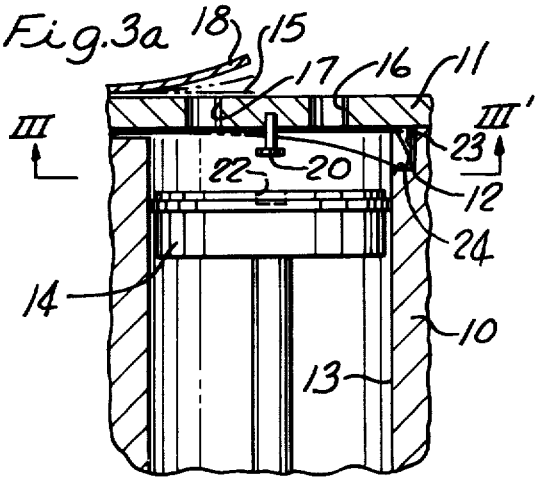
FIG. 3*a* is a sectional view of another embodiment of this invention.
Figure 3B:
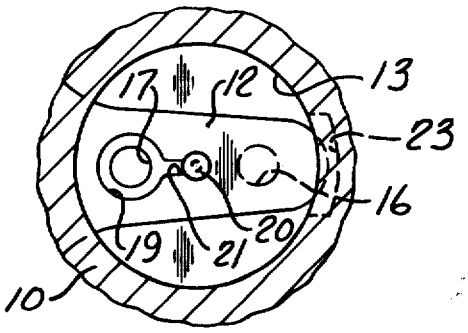
FIG. 3*b* is a sectional view taken along line III–III' in FIG. 3*a*.

Referring to FIGS. 3*a* and 3*b*, which show another embodiment, the embodiment is similar to the first embodiment shown in FIGS. 2*a* and 2*b*, except that the length of the suction reed valve 12 is extended, with the free end of the valve being received in a recess 23 formed in the inner surface of the cylinder.

The recess 23 axially extends from the end of the cylinder facing the valve plate 11 by a predetermined distance more than the length of the pin 20 and the end 24 of the recess 23 acts as a stopper for the movement of the free end of the suction reed valve 12.

In the embodiment, the suction reed valve 12 is restrained from over-bending by two means, the pin 20 and the end 24 of the recess 23, as shown by a two-dot chain line in the drawing, so that the fatigue and the breakage of the suction reed valve 12 may be suppressed. Moreover the vibration of the reed valve 12 is also suppressed.

It will be noted that the device according to this invention is suitable to be used with a driving source whose driving speed is rapidly changed. Therefore the device is suitable for a compressor for an air conditioning system for automobiles.

This invention is also applicable to a device wherein a plurality of cylinders are formed in a cylinder block with suction reed valves for respective cylinders being formed of a sheet of valve material, as disclosed in U.S. Pat. No. 3,552,886.

This invention has been described in reference to particular embodiments, which are only for the purpose of description and they are not intended to restrict this invention, and various modifications and designations may be made by those skilled in the art within the scope of this invention.

What I claim is:

1. A fluid suction and discharge apparatus comprising
a cylinder block provided with at least one cylinder,
a valve plate secured to said cylinder block to close one end of said cylinder and having an inlet port and an outlet port,
a piston slidably close-fitted into said cylinder,
a discharge reed valve disposed on an outer surface of said valve plate to close said outlet port thereof,
a suction reed valve which is secured at one end thereof and extends along the inner surface of said valve plate over said inlet port and terminates free at the other end thereof,
stopper means for restraining said suction reed valve from over-bending, which stopper means is positioned under the inner surface of said suction reed valve within the bore of said cylinder between the secured end thereof and the region thereof facing said inlet port,
said suction reed valve having a slit at a position between the secured end thereof and the region thereof facing said inlet port, said stopper means being a pin which is secured on the inner surface of said valve plate and which has a small radius portion extending through said slit of said suction reed valve and a head portion thereof having a greater radius than said slit, whereby said suction reed value may be suppressed from over-bending.

2. The apparatus as claimed in claim 1, in which said piston is formed with a recess for receiving said pin.

3. The apparatus as claimed in claim 2, in which said cylinder is formed with an axial recess in the inner surface thereof which axially extends from one end thereof facing said valve plate by a predetermined distance, said free end of said suction reed valve being received in said recess in the inner surface of said cylinder.

4. The apparatus as claimed in claim 3, in which the axial length of said recess in the inner surface of said cylinder is more than the length of said pin.

5. The apparatus as claimed in claim 2, which further comprises another stopper means for restricting the movement of the free end of said suction reed valve due to bending thereof within a predetermined extent.

6. The apparatus as claimed in claim 5, in which said cylinder is formed with an axial recess in the inner surface thereof which axially extends from one end thereof facing said valve plate by a predetermined distance, said free end of said suction reed valve being received in said recess in the inner surface of said cylinder.

* * * * *